US005115579A

United States Patent [19]

Pappas

[11] Patent Number: 5,115,579

[45] Date of Patent: May 26, 1992

[54] DEVICE FOR DRYING SURFACES

[76] Inventor: Heraklus Pappas, P.O. Box 352, Pennington 4184 Natal, South Africa

[21] Appl. No.: 669,071

[22] Filed: Mar. 14, 1991

[30] Foreign Application Priority Data

Mar. 16, 1990 [ZA] South Africa ..... 90/2019

[51] Int. Cl.[5] ..... F26B 13/26

[52] U.S. Cl. ..... 34/95.3; 34/95; 34/71; 15/98

[58] Field of Search ..... 34/95, 95.1, 95.3, 95.4, 34/71, 9; 15/98, 119 A, 97 R

[56] References Cited

U.S. PATENT DOCUMENTS

| | | | |
|---|---|---|---|
| 3,079,620 | 3/1963 | Hunter | 34/95 |
| 4,542,594 | 9/1985 | McLaughlin | 34/95 |
| 4,769,924 | 9/1988 | Hikota et al. | 34/95 |
| 4,879,820 | 11/1989 | McLaughlin | 34/95 |
| 4,989,293 | 2/1991 | Bashyam | 34/95 |

*Primary Examiner*—Henry A. Bennet
*Assistant Examiner*—Denise L. F. Gromada
*Attorney, Agent, or Firm*—Bell, Seltzer, Park & Gibson

[57] ABSTRACT

A roller for removing water from tennis courts, bowling greens, verandahs and other surfaces has a roller covered with a water absorbent material covered with a net of nylon for prevention of abrasion damage, and a handle. The handle including channels on either side sufficiently close to the surface of the absorbent material to receive water squeezed therefrom by a transverse spring loaded member. Outlet pipes are fitted to the ends of the channels and these are movable from a position in which the end is above the level of the relevant channel for retention of the water until desired to discharge it, when the pipe is swivelled to a second position in which the free end is below the channel.

4 Claims, 1 Drawing Sheet

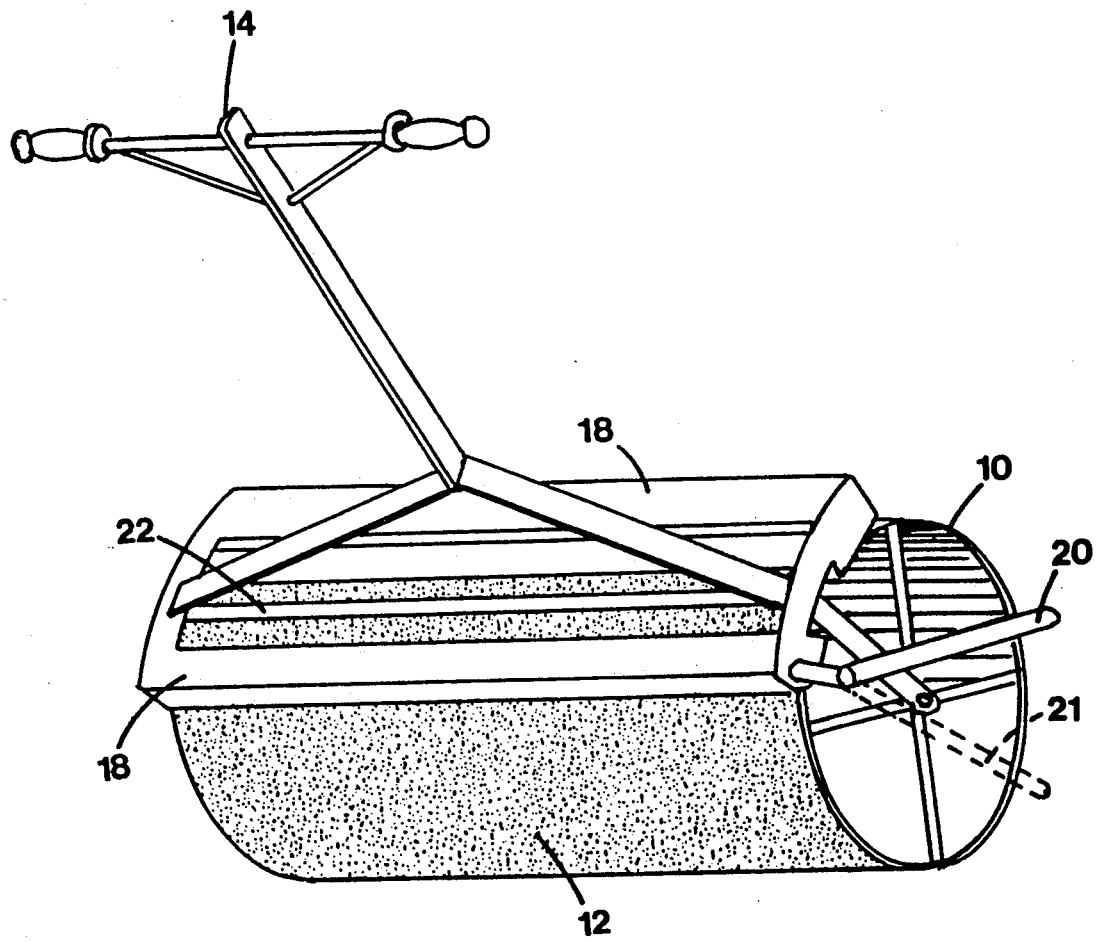
14
18
10
22
20
21
18
12

DEVICE FOR DRYING SURFACES

FIELD OF THE INVENTION

This invention relates to a device for drying surfaces and, in particular, for the drying of sporting surfaces such as tennis courts, bowling greens and the like, as well as driveways, patios and the like.

BACKGROUND OF THE INVENTION

Squeegees have been known for many years as the main device for removing water from surfaces but these merely move the water and if there are uneven surfaces, water remains in the troughs of such surfaces.

It is also known to provide a device in the form of a roller with a handle, the roller portion being covered with a sponge or other water absorbent material. The device is moved across the surface to be dried, the absorbent covering drawing up water. However, once unsaturated with water, the surface no longer absorbs water and has to be removed for removal of the absorbed water, which process is difficult and does not remove all of the water with the result that the device behaves more like a squeegee in that it moves water around the surface.

It is an object of the present invention to provide a device which is easily and inexpensively manufactured and which is far more effective in removing surface water than prior art devices.

THE INVENTION

According to the invention a device for removing surface water includes a roller covered with a water absorbent material having an element located at a zone removed from the zone of initial absorption of water, the element being adapted to impart pressure across the roller for squeezing of water from that zone of the roller; and a channel member adapted to receive the squeezed out water, the channel member having an outlet movable from a first position in which the water received is held therein and a second position in which the water flows thereout.

The roller may be provided with a conventional handle for pushing or pulling the roller and the channel is conveniently attached to the handle close to the surface of the roller.

In a preferred form of the invention a pair of channel members are provided, and these may be located on either side of the handle close to the surface of the roller so that there is an available channel member for either direction of travel of the roller.

A refinement of the invention provides for a covering of the absorbent material to r educe abrasion damage. This may take t he form of a net of nylon or other suitable polymeric yarn.

For larger surfaces the roller may be motorised.

The outlets for the channel members may comprise a bent pipe located in swivelling relationship in the ends of the channel members so that the open end thereof may be at a position above the channels for collection of water and below the channels for removal of water.

EMBODIMENT OF THE INVENTION

An embodiment o the invention is described below with reference to the accompanying drawing which is an isometric view of a roller assembly according to one form of the invention.

In the drawing a roller 10 is covered with a water absorbent material 12 and this, in turn, is covered with a net of nylon (not shown).

A handle 14 is pivoted to the axis of the roller 10 and on either side of the handle are channels 18 with outlet pipes 20 in the form of bent pipes which are swivellable between a first position as shown in solid line to retain the water in the channel and a position shown in dotted line 21 when the free end of the pipe is below the channel for running off the water. The latter operation may be performed at a location remote from the surface being dried.

It will be appreciated that the channels 18 each serve to collect water in the two operating positions of the handle.

The absorbed water is squeezed from the material 12 by means of a transverse member 22 which may be spring loaded to effect its squeezing action.

I claim:

1. A device for removing water from a ground surface, comprising:

a roller adapted to be rolled along the ground surface and having an outer surface covered with a water absorbent material, an element positioned to impart pressure to said outer surface of said roller along a horizontal line positioned above the ground surface, at least one water collection channel positioned immediately adjacent said outer surface and below said element for collecting water squeezed from said outer surface by said element, at least one water discharge pipe connected to said one water collection channel, with each of said water discharge pipes defining an outlet end, and means for permitting said outlet end of each said water discharge pipe to be moved between an operating position located above the level of said water collection channel and a water discharge position located below the level of said water collection channel.

2. The device as defined in claim 1 wherein said means for permitting said outlet end of each of said water discharge pipes to be moved between an operating position and a water discharge position comprises a swivel connection between each of said pipes and said one water collection channel.

3. The device as defined in claim 1 further comprising a handle rotatably mounted to said roller for pushing and pulling the device along the ground surface, and wherein said one water collection channel and said element are each mounted to said handle.

4. The device as defined in claim 3 wherein said device includes a pair of said water collection channels each mounted to said handle on respective opposite sides of said element and so as to be adapted to collect water irrespective of the direction of travel of the device.

* * * * *